US006051791A

United States Patent [19]

King

[11] Patent Number: 6,051,791

[45] Date of Patent: Apr. 18, 2000

[54] WATERPROOF WIRE CONNECTOR

[75] Inventor: Thomas A. King, Ballwin, Mo.

[73] Assignee: Tom King Harmony Products, Inc., Ballwin, Mich.

[21] Appl. No.: 09/098,851

[22] Filed: Jun. 17, 1998

[51] Int. Cl.[7] ..... H01R 4/00

[52] U.S. Cl. ..... 174/87

[58] Field of Search ..... 174/84 R, 86, 174/87, 74 R; 403/214, 265

[56] References Cited

U.S. PATENT DOCUMENTS

| | | | |
|---|---|---|---|
| 1,297,614 | 3/1919 | Van Viersen . | |
| 2,416,943 | 3/1947 | Nicolazzo | 174/87 |
| 3,597,528 | 8/1971 | Penfield et al. | 174/87 |
| 3,937,870 | 2/1976 | Bumpstead et al. | 174/87 |
| 4,107,453 | 8/1978 | Erixon | 174/87 |
| 4,238,640 | 12/1980 | Tweed et al. | 174/87 |
| 4,446,332 | 5/1984 | Dauser, Jr. | 174/87 |
| 5,099,089 | 3/1992 | Zan | 174/87 |
| 5,113,037 | 5/1992 | King, Jr. et al. | 174/87 |
| 5,151,239 | 9/1992 | King, Jr. | 264/272.11 |
| 5,162,617 | 11/1992 | Ferbas | 174/138 F |
| 5,252,779 | 10/1993 | DiRienzo | 174/87 |
| 5,371,323 | 12/1994 | Schneider et al. | 174/92 |
| 5,427,270 | 6/1995 | Patterson | 220/250 |
| 5,446,241 | 8/1995 | Mackaness et al. | 174/91 |
| 5,622,642 | 4/1997 | Edwards et al. | 219/542 |

*Primary Examiner*—Dean A. Reichard
*Assistant Examiner*—William H Mayo, III
*Attorney, Agent, or Firm*—Grace J. Fishel

[57] ABSTRACT

A waterproof wire connector has a tubular cap and a tubular shoe which is telescopically received in the cap. An electrical connection is made between the contacting ends of a plurality of electrical wires extending through the shoe and hooked in a slot provided at the forward end of the shoe. As the shoe is inserted into the cap, a sealant in the cap is hydraulically injected around the stripped ends of the wires electrically insulating and protecting them from oxidation.

18 Claims, 3 Drawing Sheets

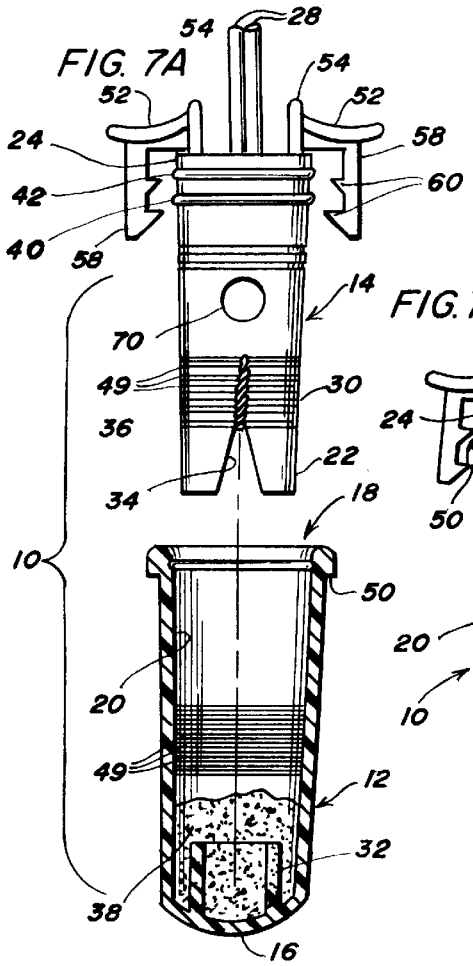
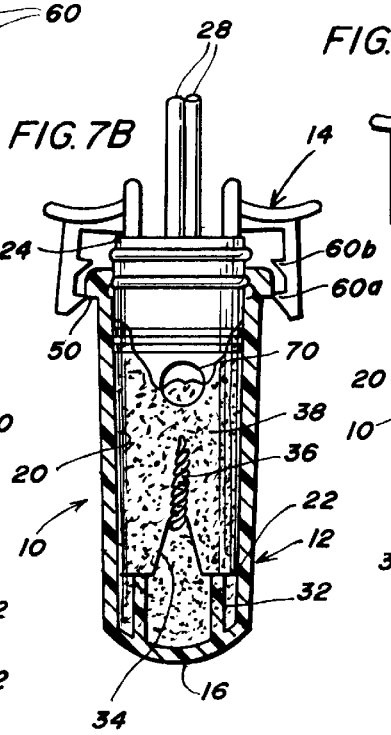
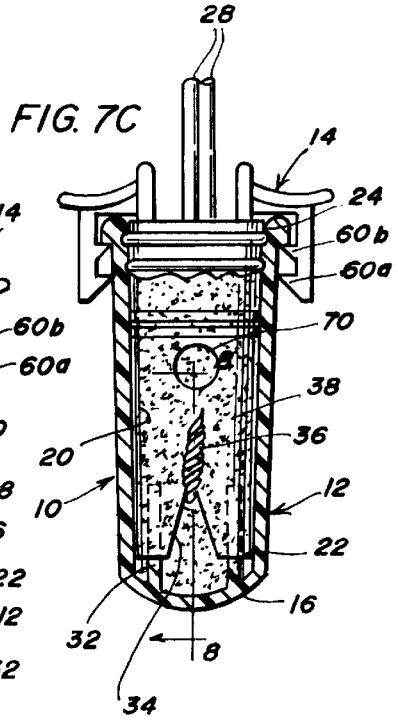
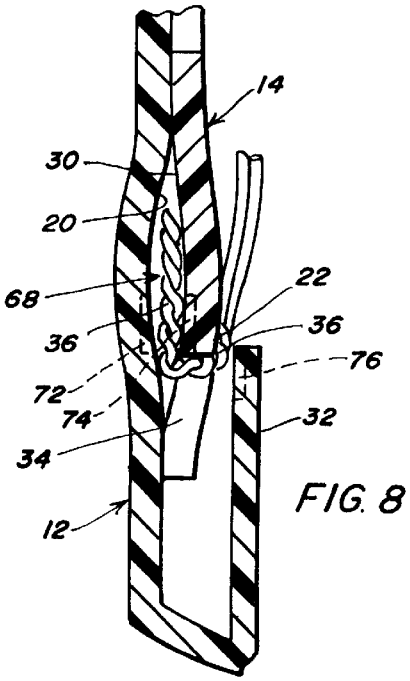
FIG. 8
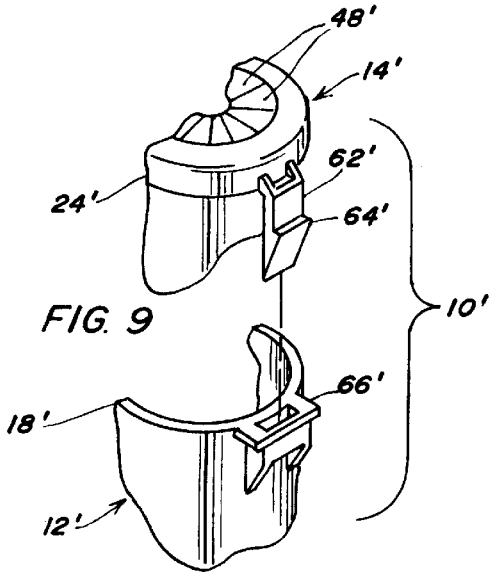
FIG. 9

WATERPROOF WIRE CONNECTOR

BACKGROUND OF THE INVENTION

1. Field of the Invention

The present invention relates to a wire connector for joining two or more electrical wires that have been stripped of insulation and for waterproofing the electrical connection.

2. Brief Description of the Prior Art

A conventional way for connecting two or more electrical wires is to peel or strip the insulation from the ends of each wire to be connected, entwine the ends of the bare wires and insert them into a cap connector, called a wire nut. The wire nut is usually formed as a small non-conductive cap having a wire receiving cavity, at least a portion of which may be lined with a low-resistance conductive surface for engaging the entwined ends of the wires. The interior surface is typically threaded to more effectively engage the wire ends. After the entwined ends are inserted into the receiving cavity, a user then holds the wires firmly in one hand and twists the wire nut with the other hand. The twisting action enables the threaded surface to pull the entwined ends further into the receiving cavity and to firmly engage the ends into a low resistance electrical contact.

The receiving cavity of the wire nut is open and does not protect the connected wires from moisture or water so that the connection may become corroded, shorting out the wires or causing them to spark. Typical electrical installations with moisture, water or flooding conditions include underground installations (such as low voltage lighting systems, lawn irrigation systems, particularly those with solenoid-operated valves, and security systems), underwater installations (such as swimming pools and marinas) and vehicle installations (such as boats, recreational vehicles and heavy construction equipment). A known solution to the problem with ordinary wire nuts is to place a pliable sealant in the receiving cavity (e.g., U.S. Pat. Nos. 5,113,037 and 5,151,239). As the bare ends of the wires to be joined are inserted into the pre-filled wire nut, they are coated with sealant, possibly interfering with the electrical connection if it has not already been made when the wires were entwined prior to insertion into the nut. In addition, as the wire nut is twisted to pull the wires into the receiving cavity, hollow channels may form in the sealant around the bare wires, along which moisture may follow which could cause corrosion.

BRIEF SUMMARY OF THE INVENTION

In view of the above, it is an object of the present invention to provide a wire connector that is simple and easy to use like a wire nut but will remain dry and corrosion-free in wet environments. It is another object to provide a wire connector forming an electrical connection of extremely high quality, both mechanically and electrically. Other objects and features of the invention will be in part apparent and in part pointed out hereinafter.

In accordance with the invention, a waterproof wire connector has a tubular cap and a tubular shoe. The cap has a closed end and an open end. The cap is partially filled at its closed end with a water resistant viscous sealant and has an inside sidewall.

The shoe has first and second ends and a bore communicating the first and second ends through which at least two electrical wires may be passed. The shoe has at least one slot at its first end for receipt of one or more of said at least two electrical wires from which any insulation has been stripped proximate the first end of the shoe. The shoe has an outside sidewall and, like the cap, is made of an electrically-nonconductive material. The outside sidewall of the shoe is complementarily shaped to the inside sidewall of the cap and sized for tight telescoping receipt of the shoe in the cap.

In use, the stripped ends of the electrical wires are hooked into the slot forming a low-resistance electrical connection between the wires. As the shoe is inserted into the cap, the wires in the slot form a pocket around the stripped ends of the wires between the inside sidewall of the cap and the outside sidewall of the shoe. At the same time, the sealant is hydraulically injected around the bare wires in the pocket and around the bare wires at the first end of the shoe, keeping them dry and protecting them from corrosion. In a preferred embodiment, a ram projects axially from the closed end of the cap for guiding the stripped wires into the slot.

The invention summarized above comprises the constructions hereinafter described, the scope of the invention being indicated by the subjoined claims.

BRIEF DESCRIPTION OF THE SEVERAL VIEWS OF THE DRAWING

In the accompanying drawings, in which several of various possible embodiments of the invention are illustrated, corresponding reference characters refer to corresponding parts throughout the several views of the drawings in which:

FIG. 7A shows an exploded view partly in section of the wire connector before the shoe is inserted into the pre-filled cap;

FIG. 7B is a view, partly in section, of the wire connector as the shoe is inserted into the cap;

FIG. 7C is a view, partly in section, of the wire connector after the shoe has been inserted into the cap and locked in place;

FIG. 8 is a sectional view on an enlarged scale taken along line 8—8 in FIG. 7C showing the pocket formed between the inside sidewall of the cap and the outside sidewall of the shoe around the wires being joined; and, FIG. 9 is a perspective view of an alternate auxiliary means for locking the shoe in the cap.

DETAILED DESCRIPTION OF THE INVENTION

Figure 1:
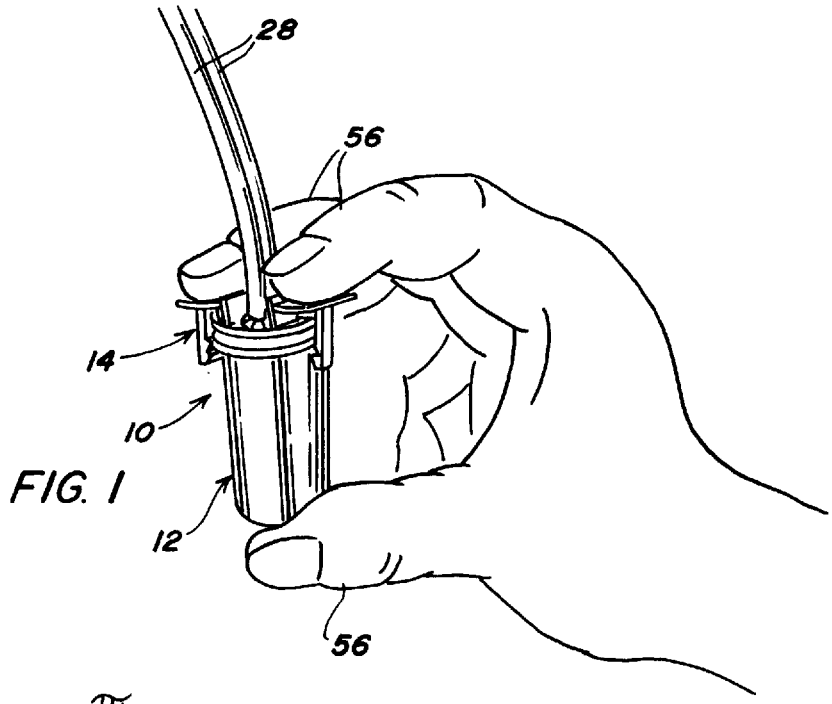
FIG. 1 is a perspective view of a wire connector in accordance with the present invention with a shoe carrying electrical wires to be joined and a cap pre-filled with a viscous sealant being telescopically snapped together under finger pressure of a user.
Figure 2:
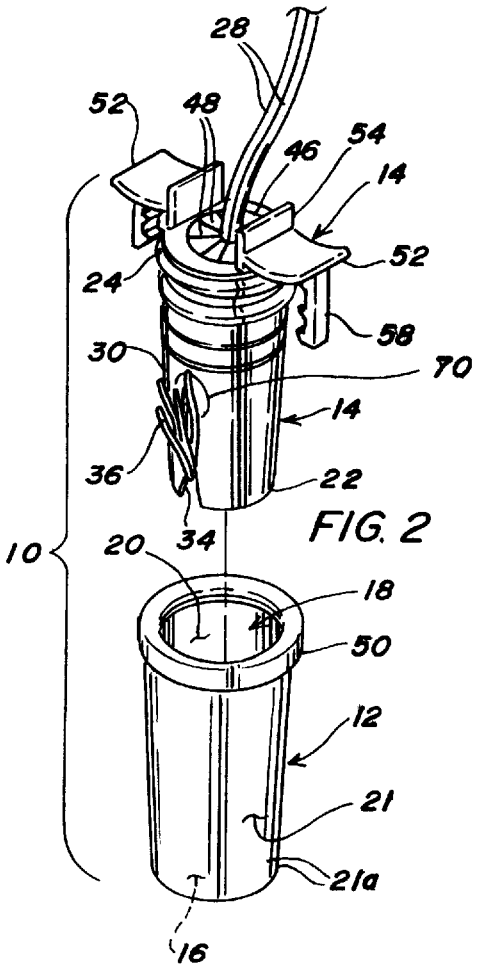
FIG. 2 is an exploded perspective view of the wire connector showing a plurality of electrical wires received in a slot provided at a first end of the shoe.

Referring to FIGS. 1–8 more particularly by reference character, reference numeral 10 refers to a waterproof wire connector in accordance with the present invention. Wire connector 10 has a tubular cap 12 and a tubular shoe 14. Shoe 14 is shorter than cap 12 for telescopic receipt in the cap.

Cap 12 may be of any suitable shape in cross-section, e.g., generally circular, rectangular, etc., as long as it has a first closed end 16 and a second open end 18. Additionally, cap 12 has an inside sidewall 20 shaped for insertion of shoe 14 as more particularly described hereinafter. Cap 12 also has an outside wall 21 which may include groove 21a for improving the quality of the grip, as well as for reinforcement.

Shoe 14 has a first end 22 and a second end 24 with a bore 26 communicating the first and second ends through which at least two electrical wires 28 may be passed. Bore 26 preferably is large in order to accommodate wires of different diameters and gauges without the need to provide different sized shoes. Shoe 14, like cap 12, may be of any suitable shape so long as its outside sidewall 30 is complementarily shaped to inside sidewall 20 of cap 12 for tight (particularly at the first end of the shoe), telescopic receipt of the shoe in the cap. Closed end 16 of cap 12 has an axially projecting ram 32 dimensioned to be telescoped into first end 22 of shoe 14. Ram 32 may be a generally cylindrical locking ring, as shown in the drawing, a solid or hollow finger or the like.

Shoe 14 has at least one slot 34 and preferably two or more slots arranged about the periphery of first end 22. Slot 34 has a width and a depth adapted for receipt of one or more of electrical wires 28 from which any insulation has been stripped proximate first end 22 of shoe 14 to expose bare wires 36. Ram 32 serves as a guiding structure for exerting pressure on electrical wires 28 in slot 34. As shown in the drawings, slot 34 is v-shaped such when bare wires 36 are hooked over first end 22 in slot 34 and pushed taut by ram 32, a quality low-resistance electrical connection is formed between bare wires 36. It will be understood that slot 34 may take other shapes such U-shaped, comma shaped, etc. The connection may be improved, as shown in the drawings, by twisting wires 28 such that they are entwined along the length where they are bare, either prior to insertion or after the shoe and cap are snapped together. If there are two or more sets of wires 28 to be joined in connector 10 forming separate junctions or circuits, each set may be received in a different one of slots 34, the sets being electrically isolated without physical contact as will be become more apparent hereinafter.

Cap 12 is partially filled at its closed end 16 with a water resistant viscous sealant 38. It is preferred that sealant 38 remain in cap 12 due to its inherent non-flowability so that it does not run out when connectors 10 are stored. Suitable viscous sealants include greases, silicones, adhesives, mastics, gels, and other materials, which under compression tend to conform and make a good seal. Viscous sealant 38 is preferably placed in cap 12 prior to use. While less preferred, as will become apparent, a portion of sealant 38 may also be placed in shoe 14 before it is inserted into cap 12.

Figure 6:
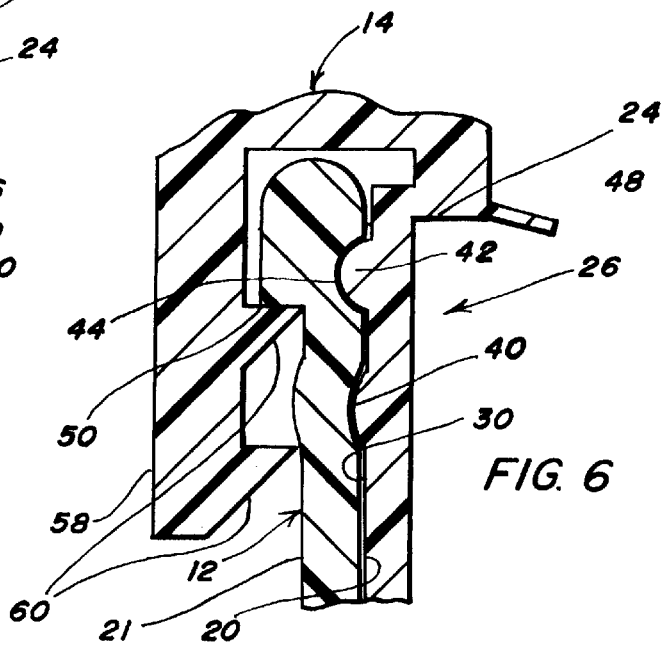
FIG. 6 is a sectional view on an enlarged scale taken along line 6—6 in FIG. 5.

As aforementioned, outside sidewall 30 of the shoe is sized for tight telescoping receipt by inside sidewall 20 of the cap. Auxiliary means, as best seen in FIG. 6, are preferably provided to lock shoe 14 in cap 12 after it has been fully inserted so that internal pressures will not force the shoe to slide out of the cap. To this end, one or more axially spaced apart retaining beads 40 extending radially outward from outside sidewall 30 are formed at second end 24 of shoe 14. A recess 44 extending completely around inside sidewall 20 of cap 12 is provided for receipt of endmost bead 40 to prevent axial withdrawal of shoe 14 from cap 12. While endmost bead 40 is shown as annular, it need only be sufficiently long so as to hold shoe 14 in cap 12. A next-to-endmost bead 42, when present, should be annular as it functions as a wiper along inside sidewall 20 of cap 12 after it passes over recess 44.

Figure 5:
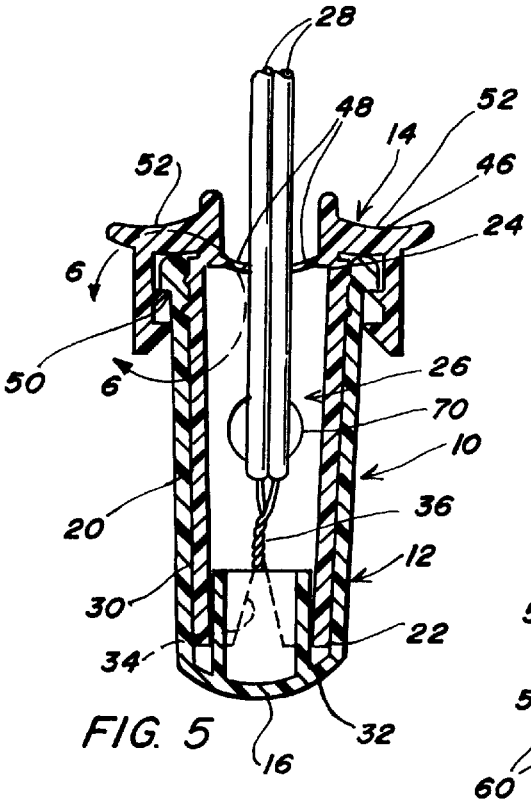
FIG. 5 is a sectional view of the assembled wire connector showing an axially projecting ram pushing the stripped wires firmly into a slot in the shoe, effecting a quality mechanical and electrical connection.

Second end of shoe 14 has a flexure cover 46 that comprises a plurality of radially projecting resilient pie shaped segments 48 that converge toward the pointed end of the segments. As best seen in FIG. 5, segments 48 yield in the axial direction as wires 28 are inserted through shoe 14 and form a conical collar to hold the wires in the center of bore 26. Segments 48 accommodate a wide range of wire diameters and gauges so that wires 28 of various sizes can be accommodated in the same shoe 14. Segments 48 also check the flow of any viscous sealant 38 that might be forced out second end 24 of shoe 14.

A plurality of striations 49 may be provided on inside sidewall 20 of the cap and outside sidewall 30 of the shoe for increasing the friction fit between the shoe and the cap, preferably locking bare wires 36 in slot 34. Additional means may be provided for locking shoe 14 in cap 12, one such means being shown in FIGS. 1–8 and a second being shown in FIG. 9. As shown in FIGS. 1–8, cap 12 is provided with an outwardly extending lip 50 at open end 18 and shoe 14 has a pair of tabs 52 projecting radially outwardly from second end 24. Each of tabs 52 includes an upstanding wall 54 which serves to protect a user's fingers 56 from any sealant 38 that may escape through segments 48 and a depending arm 58 with a pair of axially extending fingers 60. The spacing between the tips of opposing fingers 60 is less than the external diameter of lip 50 for an interference engagement between fingers 60 and lip 50. Fingers 60 are arranged on arms 58 such that when forward most bead 40 is in recess 44, the lower finger engages lip 50, with the next finger coming into play when next-to-forward most bead 42 is seated in recess 44.

Illustrated in FIG. 9, is one alternative wire connector 10' of many possible embodiments embodying the principle of the invention, with the structural or functional parts similar to those previously described in connection with the embodiment shown in FIGS. 1–8 being designated by corresponding primed reference numerals. The additional means for locking shoe 14' comprises a pair of arms 62' that project axially from first end 22' of shoe 14'. Each of arms 62' has a radially outwardly extend finger 64'. Cap 12' has a pair of loops 66' provided at open end 18' for engagement with arms 62' which snap through loops 66' but whose removal is resisted by fingers 64'.

In use, a user strips the insulation from the ends of wires 28, optionally twisting bare wires 36 together, and then hooks them in a selected slot 34 at first end 22 of shoe 14. The user then takes cap 12 in one hand and axially inserts shoe 14 into open end 18 of the cap 12 (FIGS. 7A–7B). As the shoe slides into the cap, a pocket 68 is formed (FIG. 8) around bare wires 36 between inside sidewall 20 of cap 12 and outside sidewall 30 of shoe 14. Locking ring 32 slides into the first end 22 of shoe 14, pressing bare wires 36 firmly into slot 34 and forming the electrical connection if not previously made. As shoe 14 is inserted into cap 12, sealant 38 is hydraulically injected around bare wires 36 in pocket 68 and around them in the first end of shoe 14. To facilitate the flow of sealant into pocket 68, ports 70 may be provided communicating bore 26 with outside sidewall 30. Ports 70 may be aligned with slots 34, or not, and provided in fewer or greater numbers and at various locations than as shown in the drawings. Forward most bead 40 snaps into recess 44 and then serves as a wiper along inside sidewall 20 of cap 12 until next-to-forward most bead 42 is received in recess 44. At the same time, endmost finger 60*a* snaps over lip 50, followed by next-to-endmost finger 60*b*, double-locking shoe 14 in cap 12.

The electrical connection formed with wire connector 10 is mechanically strong. If wires 28 are pulled upon, they are more likely to break than bare wires 36 are to pull loose from slot 34. The connection is also of high quality electrically. Hollows are not likely to form in sealant 38 around bare wires 36, the sealant being hydraulically injected into this area, filling any voids after the wires are in place and waterproofing the junction such that the electrical connection will remain dry and corrosion-free in wet environments.

As mentioned above, two or more sets of wires can be joined in separate circuits or junctions in wire connector 10 by placing them in different slots 34, bare wires 36 of each set being electrically isolated from the other set by sealant 38.

Figure 3:
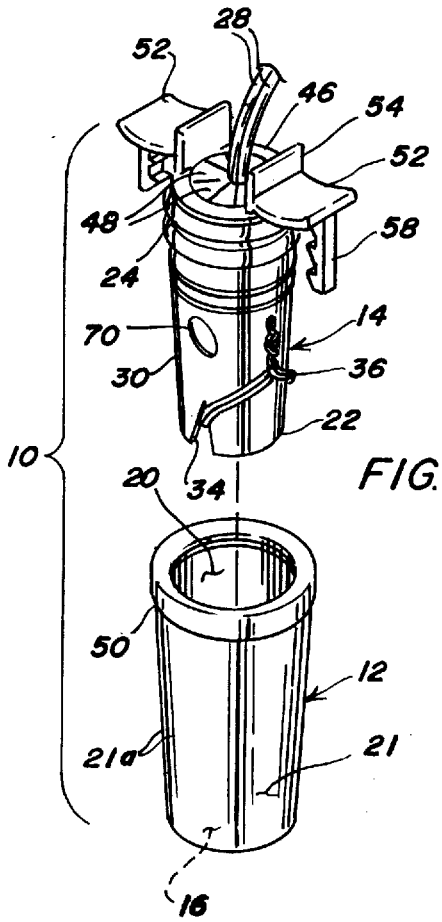
FIG. 3 is a second exploded perspective view of the wire connector showing a pair of braided or stranded electrical wires received in opposing slots and joined together by entwining the wires along the outside sidewall of the shoe.
Figure 4:
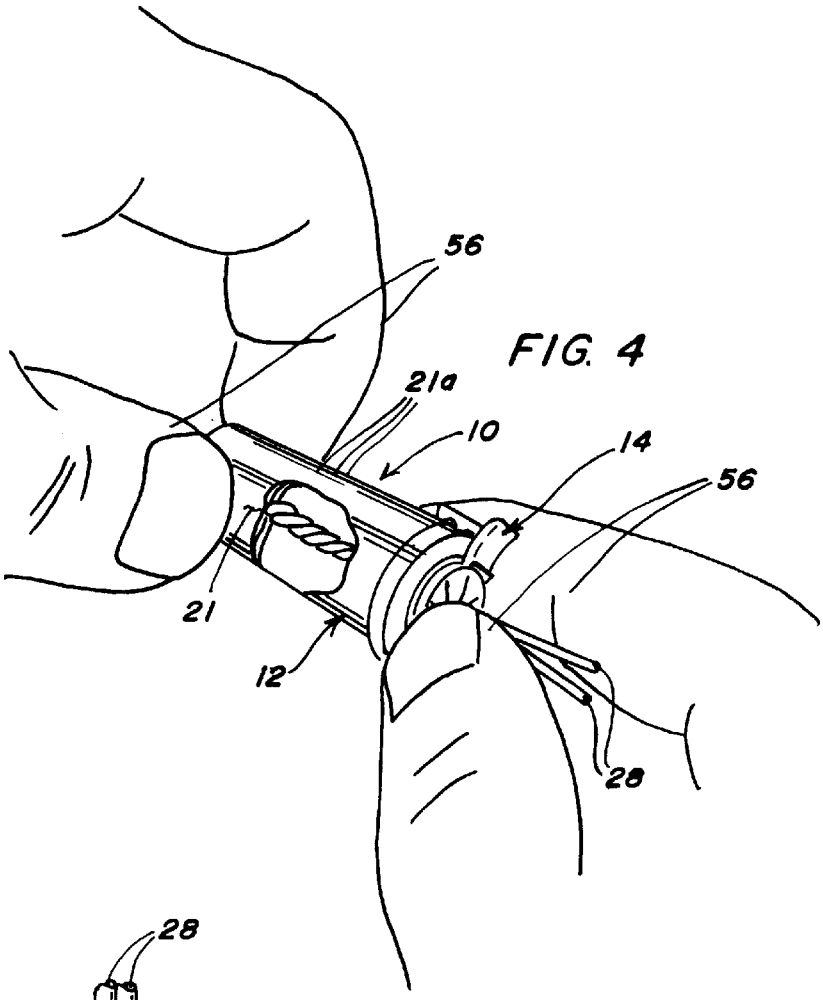
FIG. 4 is a perspective view of the wires optionally being twisted by a user to extend the area of contact between the bare wires being joined in the wire connector after the shoe and the cap have been joined.

If bare wires 36 are braided or stranded, an especially good mechanical and electrical connection can be made if they are inserted into different slots 34 and then are twisted together along the outside sidewall 30 of shoe 14 as shown in FIG. 3 prior to being inserted into cap 12. This same technique can be used with solid wires, if desired.

Other alternative embodiments of wire connector 10 are contemplated and are shown in FIG. 8. The electrical connection between the wires being joined may be made with a conductive surface engaging bare ends 36 of the wires, in the same or different slots 34. For example, a conductive surface 72 may be provided inside sidewall 20 of cap 12 in alignment with slot 34. A conductive surface 74, 76, for the same purpose, could be provided in outside sidewall 30 of shoe 14 or on locking ring 32 axially projecting from closed end 16 of cap 12, respectively, or both.

Shoes 14, 14' and caps 12, 12' of all embodiments are preferably made of an electrically-non-conductive material. One or both of shoes 14, 14' and caps 12, 12' are flexible so that pocket 68 will develop as the shoe is inserted in the cap.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A waterproof wire connector comprising:

a tubular cap with a closed end and an open end, said cap partially filled at its closed end with a water resistant viscous sealant and having an inside sidewall;

a tubular shoe with first and second ends and a bore communicating the first and second ends through which at least two electrical wires may be passed, said shoe having at least one slot at the first end for receipt of said wires having ends from which some insulation is stripped proximate the first end of the shoe forming stripped ends, said shoe having an outside sidewall;

said cap and said shoe formed of an electrically-non-conductive material, with the cap the shoe, or both, being flexible;

said outside sidewall of the shoe complementarily shaped to the inside sidewall of the cap and sized for tight telescoping receipt of the shoe in the cap;

wherein said stripped ends can be hooked into the at least slot forming a low resistance electrical connection between said wires, said wires forming a pocket around the stripped ends of the wires between the inside sidewall of the cap and the outside sidewall of the shoe when the shoe is inserted into the cap, said sealant hydraulically injected around said wires in the pocket and around said wires at the first end of the shoe as the shoe is inserted into the cap.

2. The wire connector of claim 1 wherein the inside sidewall of a cap or the outside sidewall of the shoe or both has a plurality of striations for increasing the friction fit between the shoe and the cap.

3. The wire connector of claim 1 wherein a port is provided in the shoe communicating the bore with the outside sidewall and facilitating injection of the sealant into the pocket.

4. A waterproof wire connector comprising:

a tubular cap with a closed end and an open end, said cap partially filled at its closed end with a water resistant viscous sealant and having an inside sidewall;

a tubular shoe with first and second ends and a bore communicating the first and second ends through which at least two electrical wires may be passed, said shoe having at least one slot at the first end for receipt of said wires having ends from which some insulation is stripped proximate the first end of the shoe forming stripped ends, said shoe having an outside sidewall;

said cap and said shoe formed of an electrically-non-conductive material, with the cap or the shoe, or both, being flexible;

said outside sidewall of the shoe complementarily shaped to the inside sidewall of the cap and sized for tight telescoping receipt of the shoe in the cap and said closed end of the cap having an axially projecting ram sized for telescoping receipt in the first end of the shoe;

wherein said stripped ends can be hooked into the at least one slot, said stripped ends guided into the at least one slot by the ram, while the wires form a pocket around the stripped ends of the wires between the inside sidewall of the cap and the outside sidewall of the shoe, said sealant hydraulically injected around said wires in the pocket and around said wires at the first end of the shoe as the shoe is inserted into the cap.

5. The wire connector of claim 4 wherein the inside sidewall of the cap or the outside sidewall of the shoe, or both, has a plurality of striations for increasing a friction fit between the shoe and the cap.

6. The wire connector of claim 5 wherein a port is provided in the shoe communicating the bore with the outside sidewall and facilitating injection of the sealant into the pocket.

7. The wire connector of claim 6 having additional means for locking the shoe in the cap.

8. The wire connector of claim 4 having a conductive surface for engaging the stripped ends of the wires between the inside sidewall of the cap and the outside sidewall of the shoe.

9. The wire connector of claim 8 wherein the conductive surface is on the inside sidewall of the cap.

10. The wire connector of claim 8 wherein the conductive surface is on the outside sidewall of the shoe.

11. The wire connector of claim 8 wherein the conductive surface is on the ram.

12. A waterproof wire connector comprising:

a tubular cap with a closed end and an open end, said cap partially filled at its closed end with a water resistant viscous sealant and having an inside sidewall; said cap having an outwardly extending lip and a radial recess in the inside sidewall at the open end;

a tubular shoe with first and second ends and a bore communicating the first and second ends through which at least two electrical wires may be passed, said shoe having at least one slot at the first end for receipt of said wires having ends from which some insulation is stripped proximate the first end of the shoe forming stripped ends, said shoe having an outside sidewall with a pair of axially spaced apart, forward most and next-to-forward most retaining beads extending radially outwardly and a pair of tabs at the second end of the show, each of the tabs projecting radially outwardly and having at least one axially extending finger with the spacing between opposing fingers being less than the outside diameter of the lip for interference engagement of the lip between the fingers;

said cap and said shoe formed of an electrically-non-conductive material, with the cap or the shoe, or both, being flexible;

said outside sidewall of the shoe complementarily shaped to the inside sidewall of the cap and sized for tight telescoping receipt of the shoe in the cap and said closed end of the cap having an axially projecting locking ring sized for telescoping receipt in the first end of the shoe, said beads received in said recess, the forward most bead serves as a wiper along the inside sidewall ot the cap as the next-to-forward most bead is received in the recess;

wherein said stripped ends can be hooked into the at least one slot, said stripped ends guided into the at least one slot by the locking ring, while the wires form a pocket around the stripped ends of the wires between the inside sidewall of the cap and the outside sidewall of the shoe, said sealant hydraulically injected around said wires in the pocket and around said wires at the first end of the shoe as the shoe is inserted into the cap.

13. The wire connector of claim 12 wherein the inside sidewall of the cap or the outside sidewall of the shoe or both has a plurality of striations for increasing a friction fit between the shoe and the cap.

14. The wire connector of claim 13 wherein a port is provided in the shoe communicating the bore with the outside sidewall and facilitating injection of the sealant into the pocket.

15. The wire connector of claim 12 having a conductive surface for engaging the stripped ends of the wires between the inside sidewall of the cap and the outside sidewall of the shoe.

16. The wire connector of claim 15 wherein the conductive surface is on the inside sidewall of the cap.

17. The wire connector of claim 15 wherein the conductive surface is on the outside sidewall of the shoe.

18. The wire connector of claim 15 wherein the conductive surface is on the locking ring.

* * * * *